United States Patent [19]

Willem et al.

[11] 4,254,033

[45] Mar. 3, 1981

[54] METHOD OF RECORDING X-RAY IMAGES AND IMAGING CHAMBER SUITED THEREFOR

[75] Inventors: Arnold A. Willem, Moerbeke-Waas; Johan M. Broekaert, Mortsel; Jean M. De Gueldre, Edegem, all of Belgium

[73] Assignee: AGFA-GEVAERT N.V., Mortsel, Belgium

[21] Appl. No.: 964,929

[22] Filed: Nov. 30, 1978

[30] Foreign Application Priority Data

Dec. 7, 1977 [GB] United Kingdom ..... 50954/77

[51] Int. Cl.[3] ..... G03G 13/00; G03G 15/00

[52] U.S. Cl. ..... 250/315.2; 250/315.1

[58] Field of Search ..... 250/315, 315 A

[56] References Cited

U.S. PATENT DOCUMENTS

| | | | |
|---|---|---|---|
| 3,774,029 | 11/1973 | Muntz et al. | 250/315 A |
| 3,859,529 | 1/1975 | Provdian et al. | 250/315 A |
| 3,922,547 | 11/1975 | Provdian et al. | 250/315 A |
| 3,927,322 | 12/1975 | Azzarelli et al. | 250/315 A |
| 3,961,192 | 6/1976 | Ando | 250/315 A |

*Primary Examiner*—Alfred E. Smith
*Assistant Examiner*—Thomas P. O'Hare
*Attorney, Agent, or Firm*—A. W. Breiner

[57] ABSTRACT

An apparatus and method is described for producing an electric field distribution in an imaging chamber corresponding with that of spherical caps.

By adequately choosing the distance between annular ring electrodes provided on or in the electrodes of the imaging chamber, use may be made of a high DC-voltage generator of the cascade type so that the voltage applied to each annular electrode is an integer of a basic voltage. Also the voltage over the gap may so be generated.

As a consequence, only one high DC-voltage is necessary for generating all the voltages of the whole system.

7 Claims, 8 Drawing Figures

METHOD OF RECORDING X-RAY IMAGES AND IMAGING CHAMBER SUITED THEREFOR

This invention relates to ionographic recording methods and apparatus by means of which radiographic images can be formed without the use of conventional X-ray film.

In the process of ionography as disclosed in U.S. Pat. No. 3,774,029 of Eric P. Muntz, Andrew P. Proudian and Paul B. Scott issued Nov. 20, 1973 use is made of the absorbing power for X-rays of a high atomic number gas contained at super-atmospheric pressure in an imaging chamber. The imaging chamber has a cathode and an anode located opposite to each other and separated by a gap in which the high atomic number gas is present. An image-receiving sheet is located in the vicinity of one of the electrodes and intercepts charge carriers of a given polarity liberated during exposure of an object to X-rays, which carriers as a consequence of the presence of the electric field between cathode and anode, migrate towards the electrode having a polarity opposite to their own. In consequence electric charges accumulate on the image receiving sheet in a distribution pattern representing that of the absorbed X-rays and are made visible by known techniques such as, for example, immersion in a dispersion of electrographic toner particles in an insulating liquid.

An alternative way of applying the principle of ionography is to utilise a chamber in which the liberated charge carriers migrate to a charge accumulator forming a boundary wall of the chamber and from which the pattern of accumulated charges can be transferred to or employed for inducing a corresponding electrostatic charge pattern in an image-receiving dielectric sheet located on the outside of such accumulator.

If the electric field lines in the inter-electrode gap on the one hand and the X-ray paths on the other hand do not coincide, a geometric unsharpness of the electrostatic image occurs, especially at the outer zone of the charge receptor sheet. The degree of this unsharpness increases, other things being equal, with the size of the inter-electrode gap. The X-rays and consequently the paths along which charge carriers are liberated in the imaging chamber, diverge relative to the X-ray source and if the aforesaid geometric unsharpness is to be avoided or reduced to acceptance limits the equipotential planes of the electrostatic field between the electrodes must be made to conform to or approach conformity with surfaces which are at all points normal to the X-ray paths. In practice, when using a conical X-ray beam whose axis is normal to the plane or the projected plane of the imaging chamber, this means that the said equipotential planes should ideally be of part-spherical configuration.

Equipotential planes of part-spherical form can be formed quite easily by employing concentric spherical cap electrodes. Research has however been directed to ways of establishing an electrostatic field configuration (equated with that of its equipotential planes) different from that of the electrodes. Otherwise the apparatus is of limited use. An imaging chamber having spherical cap electrodes is often inconvenient, due to the difficulty, if not impossibility, of making conventional image-receiving sheets conform to a part-spherical surface. Moreover even if that problem be ignored, there remains the limitation that the electrostatic field configuration, determined by the geometry of the electrodes, is appropriate only for one spacing of the X-ray source from the imaging chamber.

The research referred to has given rise to various proposals for varying the level of the electrical potential over the areas of the opposed electrodes in such a way that although the electrodes are physically flat the equipotential planes of the electrostatic field created between them are of part-spherical configuration.

According to U.S. Pat. No. 3,859,529 of Andrew P. Proudian, Teodoro Azzarelli and Murray Samuel Welkowsky issued July 1, 1975 the electrodes are constituted by a plurality of concentric juxtaposed annular rings which are composed of materials of different conductivity and which are connected to a source of constant DC-current of such a value that the electrical potential varies along the radial coordinate in a manner which approximates in stair-step fashion to the desired ideal. The reproducible manufacture of rings having a predetermined relation between their conductivities poses problems which it would be better to avoid.

In U.S. Pat. No. 3,922,547 of Andrew P. Proudian, Murray Samuel Welkowsky and Steven A. Wright issued Nov. 25, 1975 it is proposed to use electrodes which comprise a plurality of spaced concentric annular rings of high-conductive material on a low conductivity substrate and to apply to the concentric rings voltages such that the extensions of the electric field lines in the inter-electrode gap converge substantially to a point. Potentiometric voltage dividers are employed for creating the non-linear variations in potential from one high conductive ring to the next in each electrode.

Another way of simulating a concentric spherical cap electrode field using flat electrodes is disclosed in U.S. Pat. No. 3,927,322 of Teodoro Azzarelli, Eric P. Muntz and Paul B. Scott issued Dec. 16, 1975. This disclosure proposes the use of electrodes each of which comprises a spirally wound wire having its ends connected to an electric DC-potential source. A voltage drop occurs in each wire convolution and between adjacent convolutions. The section and specific resistance of the wire are such that an electric field is built-up wherein the potentials vary along the gap in the manner of the potentials for concentric spherical metal electrodes. When using electrodes of that form there is no possibility of compensating for local variations in the form of the spiral or of the electrical resistance of the wire.

According to the present invention there is provided a method of recording an X-ray image by means of an ionographic imaging chamber wherein the X-rays create imagewise distributed charge carriers in a gas between opposed electrodes and an electrostatic field between said electrodes causes migration of such charge carriers to bring about image-wise electrostatic charging of a dielectric image-receiving sheet, the electrodes having opposed series of spaced incremental zones of relatively high conductivity distributed and maintained at such different potentials that the equipotential planes of the electrostatic field between the electrodes approximate to a predetermined configuration different from the configuration of the facing electrode surfaces, characterised in that the distribution of said zones of each series is such that the predetermined configuration of the said equipotential planes can be achieved by bringing the said zones to different voltages whose values have a common factor and in that voltages having those values are applied to those zones as tappings from a common voltage supply circuit providing a series of voltage steps of magnitudes having said common factor.

In preferred embodiments of the invention, the predetermined equipotential plane configuration approximates to spherical caps. In other words the electric field approximates to that obtained with spherical cap electrodes with constant potential along their surfaces.

In particularly preferred embodiments the electrodes are flat and each of the said series of incremental electrode zones comprises a central circular zone surrounded by mutually spaced ring or annular zones, the distribution of said zones, (i.e., their areas and spacings) and the voltages applied thereto being such that the potential variations along the electrode surfaces substantially correspond to a concentric spherical equipotential in the imaging cap.

The invention however includes a method wherein parallel cylindrical electrodes are employed of which the incremental zones of relatively high conductivity have the form of strips running normally to the axis of the electrode curvature, the distribution of such zones and the voltages applied thereto being such that the electric potential variations along the electrode surfaces approximate to a concentric spherical equipotential in the imaging gap.

The invention includes ionographic imaging apparatus comprising an ionographic imaging chamber having flat or cylindrical electrodes each having a series of spaced incremental zones of relatively high conductivity, a DC-voltage source connected to said electrodes to maintain an electrostatic field therebetween, and a common voltage supply circuit which provides a series of voltage steps of magnitudes having a common factor and which applies voltages having that common factor to the incremental zones of the electrodes, the distribution of such incremental zones being such that the potential variations along the electrode surfaces approximate to those of spherical cap electrodes providing a concentric spheric equipotential in the imaging gap between the electrodes.

In the most preferred apparatus according to the invention the electrodes are flat and each of them has a said series of incremental zones including a central circular zone and a plurality of mutually spaced concentric ring or annular zones surrounding that central zone, the radial distance between the central zone and the mean circumference of the adjacent annular zone and between the mean circumferences of adjacent annular zones being substantially equal to each other and to the diameter of the central zone.

The distribution of the incremental electrode zones in accordance with the invention simplifies the maintenance of the zones at appropriate potentials by means of a common source of EMF. A plurality of like components can be employed in series for providing a series of equal voltage steps and an appropriate number of such components can provide the voltage step from one incremental zone to the next.

Preferably the DC-voltage creating the electric field over the inter-electrode gap is a multiple of the said common factor and that voltage is derived from the same voltage supply circuit as the voltages applied to the incremental electrode zones.

In particularly important embodiments of the invention, the common voltage supply circuit from which voltages are applied to the incremental zones of the electrodes is of rectifier/multiplier type comprising a series of multiplier units each generating a DC-voltage which is a factor common to the magnitudes of the different voltages applied to the incremental zones.

By means of a chain of rectifying units comprising two rows of series-connected capacitors and interconnected diodes a series of high DC-voltages can be generated, using an AC-voltage source of moderate power. Such a chain of units forming a so-called cascade circuit, can be used in the common DC-voltage supply circuit from which the DC-voltages to the incremental electrode zones are derived in carrying out the present invention. When using such known cascade rectifier/-multipliers, even number multiples of the basic rectified voltage are delivered by one of the rows of series-connected capacitors whereas odd number multiples of that basic rectified voltage are delivered by the other row. Such a circuit can be utilised in carrying out the invention for supplying successive incremental electrode zone voltages whose intervals over the series are odd or even number multiples of the basic voltage.

However in preferred embodiments of the present invention, the common DC-voltage supply circuit from which the DC-voltages to the incremental electrode zones are derived comprises a plurality of series connected multiplier units (hereinafter called "special multiplier units") each of which comprises first and second rectifying elements each having at least a cathode and an anode, and first and second capacitors each having first and second electrodes, the cathode of the first rectifying element being connected to the first electrode of said first capacitor and the anode of said first rectifying element being connected to the second electrode of said second capacitor; and analogously the cathode of said second rectifying element being connected to the first electrode of said second capacitor and the anode of said second rectifying element being connected to the second electrode of said first capacitor; the unit having a pair of input terminals connected with corresponding electrodes of said rectifying elements, and a pair of output terminals connected with the other electrodes of such rectifying elements.

Rectifier units as just defined are in themselves the subject of our co-pending patent application No. 50,953/77 filed Dec. 7, 1977 by Agfa-Gevaert N.V. for "High DC-voltage supply". When using a chain of such rectifier units it is very easy to tap a DC-voltage corresponding to the basic voltage generated by one unit and to tap DC-voltages corresponding to any multiple of that basic voltage.

The incremental electrode zones of relatively high conductivity can be formed in various ways, known per se. Such zones can be formed of material embedded in or applied to an electrode-forming matrix or substrate. An etching technique as known in printed circuit manufacture can be applied for converting a relatively highly conductive layer applied to a substrate of adequate conductivity into a plurality of spaced incremental zones having such relatively high conductivity.

Due to the magnitude of the DC-potentials involved the terminals of the common DC-voltage supply circuit connected to the incremental electrode zones are preferably series connected with resistors of sufficient magnitude to prevent generation of excessive shortcircuit currents in the event of inadvertent shortcircuiting occurring between adjacent incremental electrode zones.

Certain embodiments of the invention, selected by way of example, will now be described with reference to the accompanying diagrammatic drawings, in which:

FIG. 1 illustrates schematically an imaging chamber according to the invention in cross-sectional view, FIG. 2 illustrates schematically the application of DC-voltages between the ring electrodes of an imaging chamber according to the invention, FIG. 3 is a top view of a number of concentric ring electrodes, FIG. 4 gives a schematic representation of an X-ray source, the planar electrode members and the electric field distribution between successive concentric ring electrodes, FIG. 5 illustrates how the different DC-voltages are connected in the case of concentric ring electrodes and how the voltage across the gap between the planar electrode members is generated, FIG. 6 is an illustration of the way in which the elements of the high DC-voltage supplies are secured against breakdown currents in the case of short circuit between the parallelly arranged electrodes.

Figure 1:
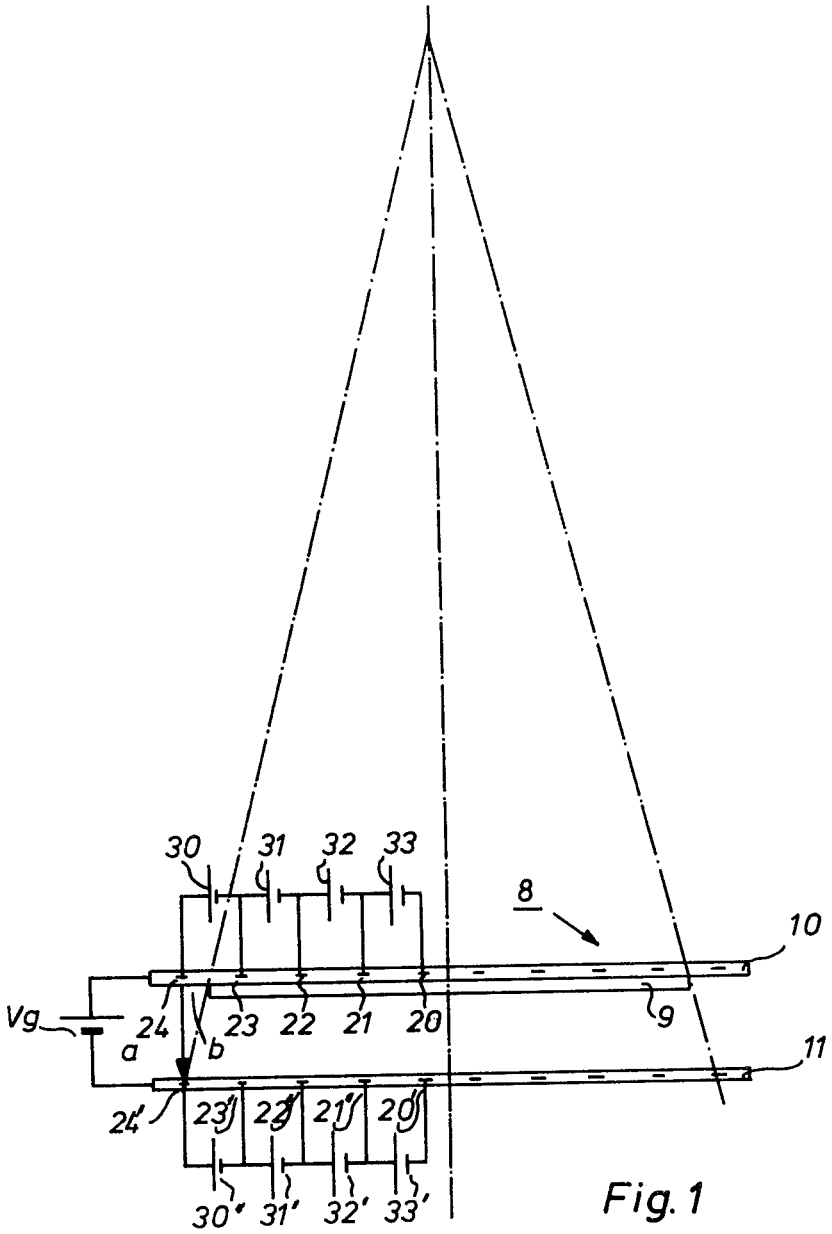

As schematically illustrated in FIG. 1, an ionography imaging chamber 8—represented in cross-sectional view—comprises electrode members 10 and 11 onto one of which a dielectric receptor sheet 9 is provided. Within the space defined by electrode members 10 and 11 is provided a radiation responsive medium, preferably a high atomic number gas, such as Xenon, which converts part of the incoming radiation (indicated in dash lines) into a charge pattern. Under the influence of a suitable electric field, created by DC-source Vg, the negative charge carriers migrate towards the electrode member 10, are intercepted by the dielectric receptor 9 and may be rendered visible by known electrographic developing techniques after withdrawal of the dielectric receptor 9 from the imaging chamber 8. It will be clear to the skilled worker that, when only the field between the electrode members 10 and 11 created by the DC-source Vg, is present, problems related to image sharpness will arise. Indeed, due to the oblique incidence of the radiation and the perpendicular orientation of the field lines, the charges which are created along the oblique line "a" will deposit on the dielectric receptor 9 over a distance indicated by the line "b" being the projection of "a" on the electrode member 10.

As it has been observed that the unsharpness of the image obtained after processing may raise to a considerable degree, especially at the areas located in the vicinity of the periphery of the dielectric carrier 9, field correcting expedients have to be provided. These field correcting expedients will provide for an alternative orientation of the electric field lines in the space defined by electrode members 10 and 11 in such a way that the lines are deviated from their parallel orientation and will point towards the source of radiation (not represented) so that they coincide with the orientation of the emitted radiation.

A convenient way to provide for the necessary field correction may be obtained by the addition of a supplementary electric field to the field existing between electrode members 10 and 11. The configuration of said field on each electrode member must be such, that it conforms to a spherical cap, the centre of the sphere being the source of radiation. The final field existing at the electrode members 10 and 11 of the ionography imaging chamber 8 will thus conform to concentric spherical caps, whereby the difference between the fields between both electrodes will be equal to the initial field, generated by the DC-source Vg.

It will be clear to those skilled in the art that geometrically correct spherical fields are very difficult to be built-up and that for the sake of convenience recurrence will be made to approximations.

To this end, electrode members 10 and 11 are provided with supplementary concentric ring electrodes 20,21,22,23,24, . . . respectively 20',21',22',23',24', . . . to which suitable electric DC-potentials delivered by DC-sources (indicated 30 . . . 33 . . . and 30' . . . 33' . . . ) are applied. The concentric ring electrodes 20 . . . 24 . . . and 20' . . . 24' . . . may be formed by selective etching techniques or may be even embedded in the electrode members 10 and 11 during the manufacture thereof. The DC-sources 30 . . . 33, 30' . . . 33' produce an electric DC-voltage which is generated by a rectifier/multiplier circuit, which itself is compound of a plurality of rectifying units (such as 33), each unit generating the same DC-voltage. As a consequence the voltages 30 . . . 33, 30' . . . 33' are each integers of a basic voltage (see further FIG. 7).

The relation existing between the DC-potentials of the sources 30 . . . 33 . . . , 30' . . . 33' . . . and Vg may be expressed as follows:

$$E_{30} - E_{30'} = Vg$$
$$E_{31} - E_{31'} = Vg$$
$$E_{32} - E_{32'} = Vg$$
$$\vdots$$
$$\text{and } E_{30} > E_{31}\, E_{32}$$
$$E_{30'} > E_{31'} > E_{32'}$$

The relationship existing between $E_{30}$, $E_{31}$, $E_{32}$ . . . and $E_{30'}$, $E_{31'}$, $E_{32'}$. . . is such that both systems conform to the equation of concentric circles and moreover to concentric spheres when the electrode members 10 and 11 have a circular shape (as here assumed).

Figure 2:
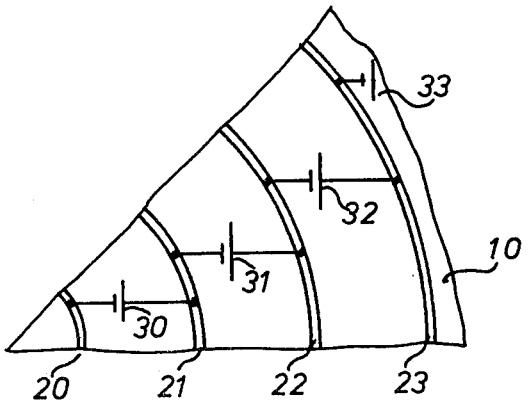

FIG. 2 is a partially schematic representation of a fragment of a planar electrode member 10 onto which are provided ring electrodes 20,21,22,23 to which are connected DC-voltage sources 30,31,32,33, . . . (symbolically represented as batteries) so that between each couple of ring electrodes a certain DC electric field is established. This field is not constant in magnitude, but increases from the center electrode 20 towards the outer ones. Consequently the electric field of the highest magnitude exists between the i−1th and the i-th ring, the latter being the last or outermost one of the series.

Figure 3:
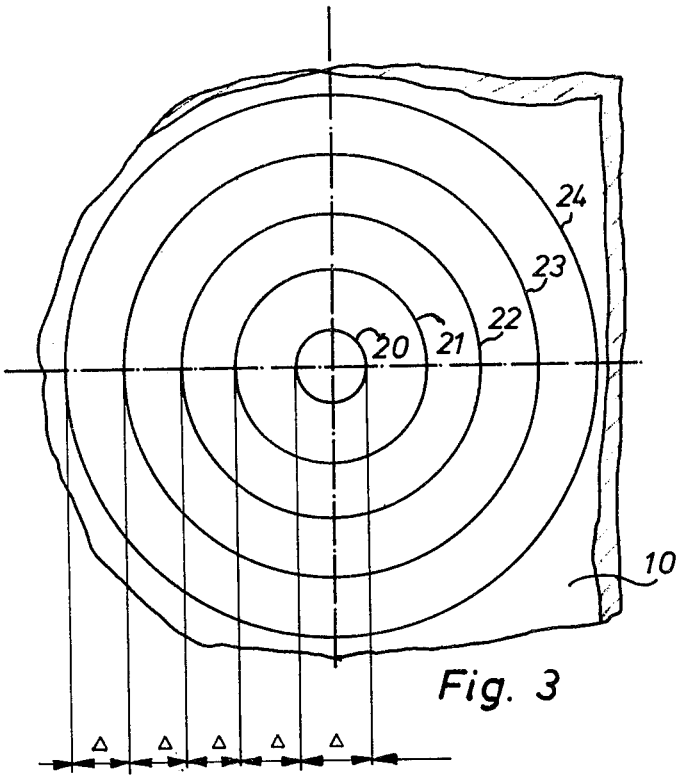

The top view of one planar electrode member 10 in FIG. 3 illustrates the way how the concentric ring electrodes 20 . . . 24 . . . are positioned relative to each other. As will be explained hereinafter, electrodes 20 . . . 24 . . . are concentrically arranged versus each other over a distance which equals the diameter of inner electrode 20.

Figure 4:
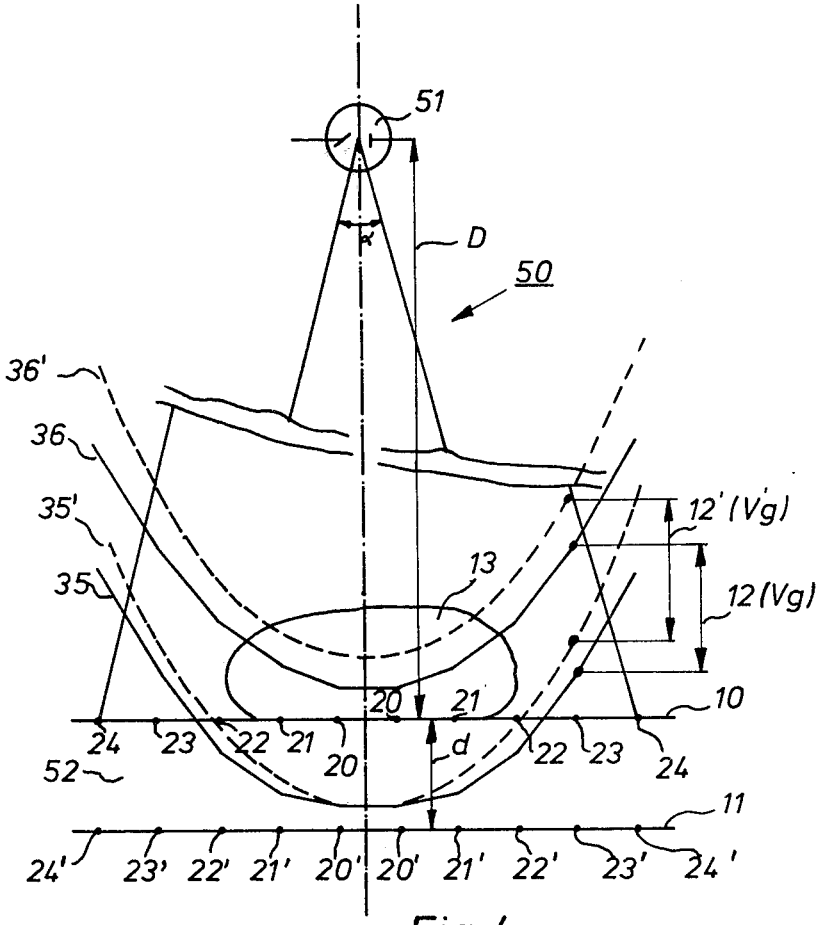

The cross-section according to FIG. 4 diagrammatically illustrates how a radiographic unit using an imaging chamber according to the invention is working.

Such a radiographic unit 50 comprises a source of penetrating radiation 51 and an imaging chamber 52 from which only the planar electrode members 10 and 11 are diagrammatically represented for the sake of clarity, the working principle of such imaging chamber being sufficiently known from the cited prior art devices and publications. Across the gap defined by the electrode members 10 and 11 a suitable electric field is created, which is preferably variable. The body 13 to be radiographed is located between the source of penetrating radiation 51 and the imaging chamber 52. On the electrode member 10 are provided the ring electrodes 20 . . . 24 . . . and on the electrode member 11 the ring electrodes 20' . . . 24' . . . respectively.

The source of penetrating radiation 51 is located at a distance D above the imaging chamber 52, which itself has a gap width which is denoted as d.

The electric voltage profile over the electrode member 11 is represented by the discontinuous curve 35 and the profile over electrode member 10 is indicated by the reference numeral 36. The voltage difference distribution between both electrode members 10 and 11, being the field over the gap of the imaging chamber 52 is referred to an numeral 12 and is a constant which will be identified by the symbol Vg.

In order to create an electric field over electrode members 10 and 11 which has the form of concentrical spherical caps, the art of reference teaches that the distribution of the electrostatic voltages $V_1$ and $V_2$ at the surfaces of electrodes 10 and 11 must satisfy the respective equations:

$$V_1 = Vg \cdot \frac{D}{d}(1 + x^2/D^2)^{-\frac{1}{2}} \text{ for electrode 10}$$

$$\text{and } V_2 = Vg \cdot \frac{D+d}{d}[1 + x^2/(D+d)^2]^{-\frac{1}{2}} \text{ for electrode 11}$$

in which $V_1$ and $V_2$ are the potentials at a distance x from the center of electrode member 10 and 11, respectively, Vg is the voltage difference between corresponding ring electrodes on electrode members 10 and 11, x is the distance from the ring to the center of an electrode member.

The foregoing equations may be substantially simplified when taking into account that the distance D is great when compared with the thickness d of the gap, which condition is generally fulfilled in practice. The simplified equation which results after a series expansion reads as follows:

$$Vr = \frac{Vg}{d} \cdot \frac{r^2}{2D}$$

and illustrates that the voltage Vr at points, located at a given distance r from the center of electrode member 10 or 11 varies according to a parabolic distribution, since the only variable in the second factor of the equation is the square of the distance between said points and the center of the said electrode members.

When the case is considered that instead of one continuous electrode member 10 or 11, the latter is subdivided into concentrical zones lying between two equispatially arranged ring electrodes 20 . . . 24 . . . , the potential at which such ring electrode has to be brought is determined by the equation:

$$V_{i+1} = V_1 + i(i+1)k\Delta^2$$

$V_{i+1}$ being the potential of the i+1th ring electrode $V_1$ being the potential of the first ring electrode Δ being the constant distance between successive ring electrodes k being a constant and equal to Vg/(2Dd)

Indeed $r_1, r_2 \ldots r_{i-1}, r_i, r_{i+1}$ being the radii of successive ring electrodes and $V_1, V_2 \ldots V_{i+1}, V_i, V_{i+1}$ their respective voltages, one may conclude $$r_i = r_{i-1} + \Delta$$

The voltage difference between rings with radius $r_i$ and $r_{i+1}$ is defined as follows:

$$V_{i+1} - V_i = k(r_{i+1}^2 - r_i^2)$$
$$\text{or} \quad = k\Delta(\Delta + 2r_i)$$
$$\text{also } V_i - V_{i-1} = k\Delta(2r_1 - \Delta)$$
$$\text{or } (V_{i+1} - V_i) - (V_i - V_{i-1}) = 2k\Delta^2$$

and by successively applying the recursion rule as above, one finds:

$$V_{i+1} - V_i = (V_2 - V_1) + (i-1)k\Delta^2, \text{ i being } \geqq 2$$

It has been found that also $V_2 = V_1$, being the potential difference between the first and the second ring may also equal $2k\Delta^2$ when $r_1 = \Delta/2$.

The final configuration of ring electrodes 20 . . . 24 . . . on electrode member 10 and 20' . . . 24' . . . on electrode member 11 will be such that the respective ring electrodes are located at a distance Δ from each other which equals the diameter of the first or inner ring electrode. In this way, the voltage differences between adjacently positioned ring electrodes behave in such a way that they relate according to a geometrical progression. This enables to make use of a high DC-voltage source of the rectifier/multiplier type from which voltages may be derived which are multiples of one integer.

Following values of the parameters may be taken in practice $Vg = 14.4 \text{ kV} = 45 \times (V_{r21} - V_{r20})$
$D = 180$ cm
$d = 1$ cm
$\Delta = 2$ cm
$2k\Delta^2 = 320$ volts
so that the voltages of
ring electrode 20 = 40 V = $V_{r20}$
ring electrode 21 = 360 V = 40 + 320 = $V_{r21}$
ring electrode 22 = 1000 V = 40 + 3 × 320 = $V_{r22}$
ring electrode 23 = 1960 V = 40 + 6 × 320 = $V_{r23}$
. . . .
. . . .
. . . .

The voltage differences between the ring electrodes satisfy the following rule:

$V_{r21} - V_{r20} = 1 \times 320$ V
$V_{r22} - V_{r21} = 2 \times 320$ V
$V_{r23} - V_{r22} = 3 \times 320$ V
. . .
. . .
. . .

The building-up of such a voltage series may thus be obtained in accordance with the invention by voltage multiplication starting from a rectifier unit which produces a DC-voltage of 320 Volts. A suitable unit is described in our already mentioned co-pending application Ser. No. 50,953/77 entitled "DC-voltage supply".

It is also possible to make $V_g$ as a plurality of "units" of the basic DC-voltage. Therefore in the equation $$V_r = V_g \frac{r^2}{2Dd}$$

the factor Dd must be an integer. When, as in practice, D is equal to 180 cm and d to 1 cm, for example, it may be derived, in that particular case, that $V_g=45$ times the voltage between the first and second ring electrodes 20 and 21.

The use of a rectifier/multiplier high DC-voltage supply in accordance with the invention permits to substantially reduce the space occupied by the DC-supply so as to provide for an extremely easy regulation when one of the parameters of the process such as the DC-voltage itself or the distance D varies.

This is illustrated in FIG. 4 in case the voltage $V_g$ over the gap is varied to the voltage $V_g'$. In this event the distribution of the electric field over the electrode members 10 and 11 will be shifted from the curves denoted 35 and 36 respectively to the curves 35' and 36' respectively.

Figure 5:
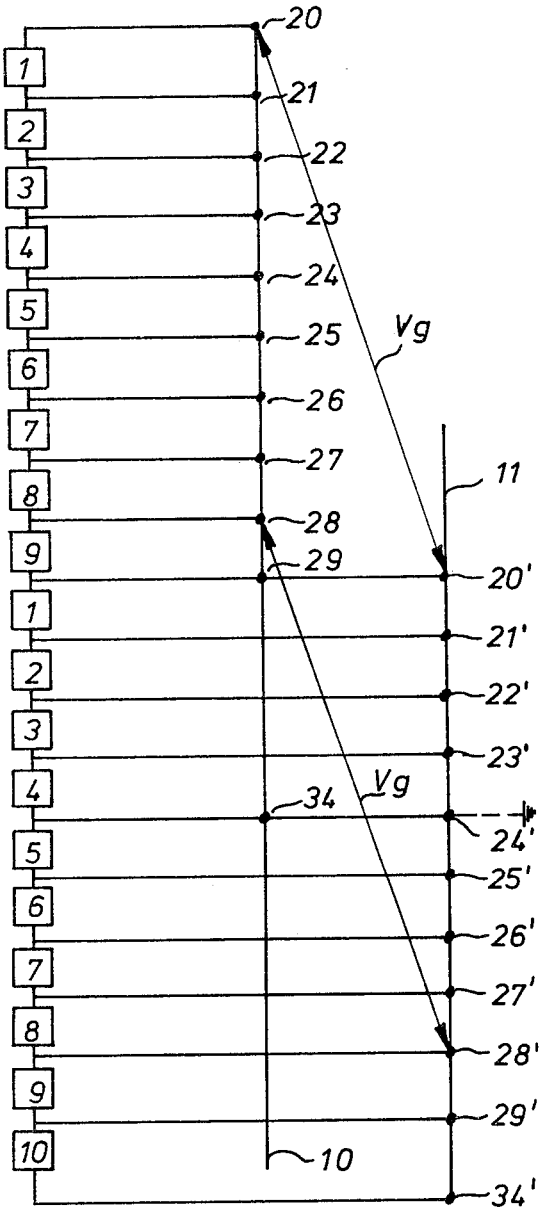

The scheme of the general set-up of the DC-supplies for an ionography imaging chamber is illustrated in FIG. 5. One must bear in mind that the electrode members 10 and 11 which are connected with the ring electrodes 20 to 24 . . . and 20' to 24' . . . respectively are in a material which in no way could be responsible for short circuits between the concentric ring electrodes. As already mentioned hereinbefore, the materials from which such electrode members 10 and 11 are made show a relatively high specific resistance which may e.g. in the range between $10^7$ and $10^{11}$ Ohm/cm.

The numbers in the small squares represent the number of "units" of rectified DC-voltage (produced by a rectifying unit such as 33) existing between the ringlike electrodes. As may be seen, the voltage at ring 29 of electrode member 10 serves also as the voltage at ring 20' of electrode member 11. Between rings 29 and 34, there are provided $1+2+3+4=10$ "units", the points inbetween being chosen to derive the voltages at ring electrodes 21', 22' and 23'. The zero level is chosen at ring electrode 24' of the electrode member 11. It will be clear that between the corresponding couples of ring electrodes 20, 20', 21, 21' . . . etc., there will always be an equal number of "units", the voltage formed by the latter equalling $V_g$ as in our particular case 45 units are each time provided between said corresponding ring electrodes.

It will be clear to the skilled worker that instead of a voltage rectifier/multiplier also more conventional means for obtaining the described result may be used. So, it is equally possible to start with an extremely high voltage rectifier and to derive the potential of each electrode 20 . . . , 20' . . . and the voltage $V_g$ across the gap by using conventional potentiometer circuits. It must be emphasized, however, that in this case very high values of the resistors constituting such potentiometer are required and that this resistive charge dissipates an amount of electric energy which may rise to a considerable level. The advantage of the ring electrode configuration will then be such that the potentiometer chain may be built-up by a plurality of identical resistors and that no complicated problems for what concerns the voltage division arise.

It may happen that, due to imperfections in the material from which electrode members 10 and 11 are made an electrical breakdown between adjacent ring electrodes might occur, which could be detrimental to the diodes of a "unit" producing a basic DC-voltage or a plurality thereof.

Figure 6:
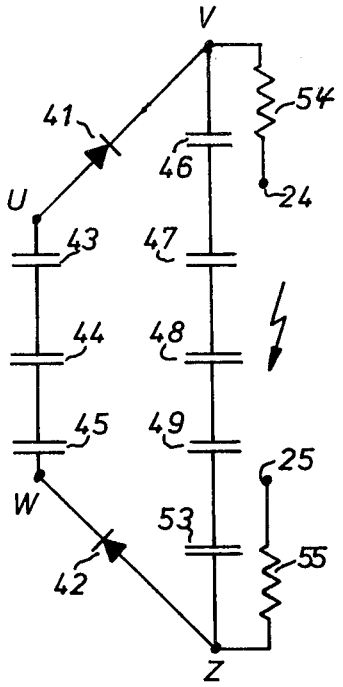

In FIG. 6 is illustrated part of such a unit 40 from which only the elements which are directly connected with the ring electrodes (in this case ring electrodes 24–25) are represented. These elements are the diodes 41 and 42 and the capacitors 43, 44, 45 and 46, 47, 48, 49 and 53 and the resistors 54 and 55. It will be appreciated that, in normal use, the voltage over the points VZ, bridging five capacitors in this particular case will be greater than that over the points UW which bridge only three capacitors.

In the absence of resistors 54,55 and during an electric breakdown between the electrodes 24,25, there will be a high current due to the release of the energy accumulated in the capacitors 46,47,48,49 and 53. After a small lapse of time, however, the voltage over points VZ has dropped to such a degree that also capacitors 43,44,45 start to unload. At that moment a current through the diodes 41,42 will originate which may be high enough to destroy the latter.

In order to limit the current during an occasional breakdown, resistors 54,55 are coupled in series with the electrodes 24 and 25 respectively, so that the magnitude of the short circuiting current is kept between safe limits.

Figure 7:
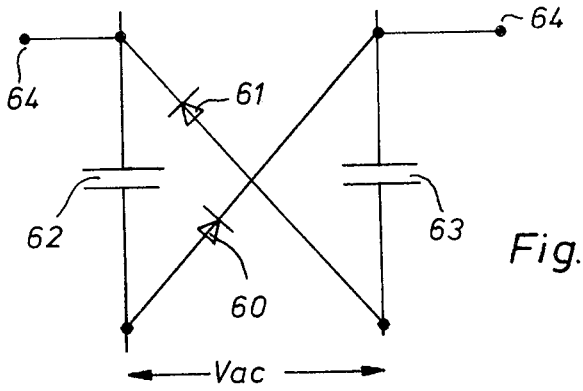
FIG. 7 is the electric scheme of a rectifying unit suitable for being incorporated in a rectifier/multiplier for generating the high DC-voltages between the concentric ring electrodes of an imaging chamber according to the invention.

The basic design of a rectifier unit such as 33 in FIG. 1 is illustrated in FIG. 7. As may be derived, said rectifier unit 33 comprises two rectifiers 60 and 61 and two capacitors 62 and 63. The capacitors 62 and 63 are loaded by the rectifiers 60 and 61 when the alternating voltage $V_{AC}$ at the terminals acting as input terminals makes the rectifiers conducting. So capacitor 62 is loaded by diode 61 during that part of the AC-cycle that the anode of diode 62 has a positive polarity. During the next part of the cycle, it is capacitor 63 which is loaded by diode 60. After one complete cycle of the AC-voltage, both capacitors 62 and 63 are loaded to approximately the peak value of the AC-voltage. The loads (in our case a concentric ring electrode) are connected between the output terminals 64 and the ground. In case a plurality of rectifying units 33 are connected in series, the output terminals of the first one will act as input terminals for the second one, etc. The diodes 62 and 63 may be semiconductor devices and may even be provided with supplementary control electrodes—such as is done for thyristors—for the purpose of regulating the output DC-voltage of each rectifier unit. The unit 33, as a consequence of its compact form may be mounted in a casing 65 for more convenience and safety whereinafter the residual space in the casing may be filled with a highly insulating substance.

Figure 8:
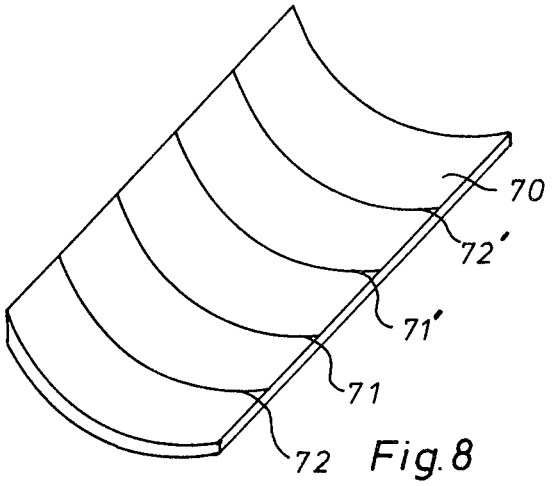
FIG. 8 is a view in perspective of an electrode of an imaging chamber in cylindrical form.

FIG. 8, finally, illustrates in perspective how the configuration of the auxiliary electrodes may be realized when the electrode 10 or 11 as illustrated in the preceding figures assume a cylindrical form.

Such electrode 70 is provided, with symmetrically arranged strip electrodes 71,72 . . . , 71',72' . . . which are parallelly positioned with respect to each other. The strip electrodes 71,72 . . . , 71',72' . . . run normally to the axis of the curvature of the electrode 70. It will be clear that (although not illustrated) another cylindrical electrode will be provided in parallel relationship with electrode 70 in order to form an imaging chamber of the type referred to.

The strip electrodes are interconnected as illustrated. So strip electrode 71 and 71', 72 and 72' are brought at the same DC-potential which is derived from a voltage rectifier/multiplier as hereinbefore referred to. Just as it is the case in the foregoing description, the voltage rectifier/multiplier is built-up of a plurality of identical rectifying units such as 33 which are interconnected in cascade and each of which producing a basic DC-voltage. In so doing the DC-voltage between adjacently positioned strip electrodes 71,72 . . . , 71',72' . . . will be an integer of the basic voltage produced by each rectifying unit. As a consequence an electric field may be built-up normal to the axis of curvature of electrode 70 which obeys the equation of a circular configuration.

The embodiments of the invention in which an exclusive property or privilege is claimed, are defined as follows:

1. Ionographic imaging apparatus comprising an ionographic imaging chamber having flat electrodes each having a series of spaced incremental zones of relatively high conductivity, a DC-voltage source connected to said electrodes to maintain an electrostatic field therebetween, and a common voltage supply circuit which provides a series of voltage steps of magnitudes having a common factor and which applies voltages having that common factor to the incremental zones of the electrodes, the distribution of such incremental zones being such that the potential variations along the electrode surfaces approximate to those of spherical cap electrodes providing a concentric spheric equipotential in the imaging gap between the electrodes, the DC-voltage from said DC-voltage source creating the electric field over the inter-electrode gap being a multiple of said common factor and derived from the same voltage supply circuit as the voltages applied to the incremental electrode zones.

2. Ionographic imaging apparatus according to claim 1, wherein each of the said series of incremental zones includes a central circular zone and a plurality of mutually spaced concentric ring or annular zones surrounding that central zone, the radial distance between the central zone and the mean circumference of the adjacent annular zone and between the mean circumferences of adjacent annular zones being substantially equal to each other and to the diameter of the central zone.

3. Ionographic imaging apparatus according to claim 1, wherein the common voltage supply circuit from which voltages are applied to the incremental zones of the electrodes is of rectifier/multiplier type comprising a series of multiplier units each generating a DC-voltage of a value which is a factor common to the magnitude of the different voltages applied to the incremental zones.

4. Ionographic imaging apparatus according to claim 1, wherein the terminals of the common DC-voltage supply circuit connected to the incremental electrode zones are series connected with resistors of sufficient magnitude to prevent generation of excessive short-circuit currents in the event of inadvertent short-circuiting occurring between adjacent incremental electrode zones.

5. Ionographic imaging apparatus comprising an ionographic imaging chamber having cylindrical electrodes each having a series of spaced incremental zones of relatively high conductivity, a DC-voltage source connected to said electrodes to maintain an electrostatic field therebetween, and a common voltage supply circuit which provides a series of voltage steps of magnitudes having a common factor and which applies voltages having that common factor to the incremental zones of the electrodes, the distribution of such incremental zones being such that the potential variations along the electrode surfaces approximate to those of spherical cap electrodes providing a concentric spheric equipotential in the imaging gap between the electrodes, the DC-voltage from said DC-voltage source creating the electric field over the inter-electrode gap being a multiple of said common factor and derived from the same voltage supply circuit as the voltages applied to the incremental electrode zones.

6. Ionographic imaging apparatus according to claim 5, wherein the common voltage supply circuit from which voltages are applied to the incremental zones of the electrodes is of rectifier/multiplier type comprising a series of multiplier units each generating a DC-voltage of a value which is a factor common to the magnitude of the different voltages applied to the incremental zones.

7. Ionographic imaging apparatus according to claim 5, wherein the terminals of the common DC-voltage supply circuit connected to the incremental electrode zones are series connected with resistors of sufficient magnitude to prevent generation of excessive short-circuit currents in the event of inadvertent short-circuiting occurring between adjacent incremental electrode zones.

* * * * *